US007454847B1

(12) United States Patent
Miller

(10) Patent No.: US 7,454,847 B1
(45) Date of Patent: Nov. 25, 2008

(54) SEDIMENT AND SLUDGE DEWATERING BY VACUUM BAG METHOD

(76) Inventor: Roger G. Miller, 5308 S. 12th St., Sheboygan, WI (US) 53081

( * ) Notice: Subject to any disclaimer, the term of this patent is extended or adjusted under 35 U.S.C. 154(b) by 0 days.

(21) Appl. No.: 11/639,357

(22) Filed: Dec. 15, 2006

Related U.S. Application Data

(60) Provisional application No. 60/755,548, filed on Dec. 30, 2005.

(51) Int. Cl.
*F26B 5/14* (2006.01)

(52) U.S. Cl. ..... 34/398; 34/397

(58) Field of Classification Search ..... 405/36, 405/128.2; 37/317, 307; 210/525; 34/397, 34/398, 69
See application file for complete search history.

(56) References Cited

U.S. PATENT DOCUMENTS 4,483,641 A * 11/1984 Stoll ..... 588/249
4,606,674 A * 8/1986 Capron ..... 405/224
4,984,594 A 1/1991 Vinegar et al. ..... 134/21
2006/0102565 A1 5/2006 Alford

OTHER PUBLICATIONS

Vacuum Consolidation, ISSMFE-TC-17 (4) pp. by Menard.
Dredging and Management of Dredged Material, GEO Institute by Meegoda, et al. Jul. 16, 1997 (18) pages.
Vacuum Consolidation, GEO Odyssey ASCE/Virginia Tech, Jun. 9, 2001 by Masse, et al. (23) pages.

* cited by examiner

*Primary Examiner*—Kenneth B Rinehart
(74) *Attorney, Agent, or Firm*—Donald J. Ersler

(57) ABSTRACT

Dredged sediment or sludge dewatering by vacuum bag method preferably includes a foundation, at least one sediment enclosure, a porous media spacer, an air impermeable sheet, and a vacuum source. The foundation may be air permeable or impermeable. The sediment enclosure is filled with sediment or sludge. The porous media spacer is placed against at least one perimeter surface of the sediment enclosure. At least one drain tube may be used to drain water. The air impermeable sheet is placed over the at least one sediment enclosure and the porous media spacer and the perimeter is sealed to an impermeable foundation. A vacuum is applied to the porous media spacer to remove water. A second embodiment uses a second air impermeable sheet. A third embodiment uses a barge. A fourth embodiment discloses a composite vacuum bag. A fifth embodiment discloses the composite vacuum bag with inflatable flotation.

11 Claims, 4 Drawing Sheets

SIDE VIEW

SIDE VIEW

END VIEW

END VIEW

SEDIMENT AND SLUDGE DEWATERING BY VACUUM BAG METHOD

CROSS-REFERENCES TO RELATED APPLICATIONS

This is a nonprovisional patent application taking priority from provisional application No. 60/755,548 filed on Dec. 30, 2005.

BACKGROUND OF THE INVENTION

1. Field of the Invention

The present invention relates generally to dewatering mixtures of fine-grained material and water, and more specifically to dredged sediment and sludge dewatering by vacuum bag method, which decreases time and complexity of water removal from dredged sediment and sludge.

2. Discussion of the Prior Art

Dredging spoils were historically disposed wherever most conveniently dumped, on land or at sea. Increasing regulation in recent decades has required controlled disposal of contaminated sediment on land. This has led to development of economical dewatering methods for all of the sediment material types, except those containing significant amounts of fine-grained organic matter. Sediment from marine, brackish, and fresh-water bodies may consist of a wide range of material types, including sand (with or without gravel), inorganic silt, clay, organic silt, and peat (fibrous as well as amorphous).

Dredged sand and inorganic silt have relatively low water content after a short amount of settling time. Water readily drains from sand by gravity alone. The small inter-granular pore spaces within inorganic silt results in capillary tension that resists dewatering, but that can be overcome by centrifuging or vacuum belt operations to remove the relatively small amount of water that remains after settling, if that is required. Wet clay is commonly stabilized by the addition of lime, which chemically reacts with both the interstitial water and the alumino-silicates that form the clay minerals. Fibrous peat and some waste sludge materials can de-watered effectively by belt press or mechanical press. Air-drying can be effective with any dredged sediment or sludge material, but may be countered by rainfall unless the large area required for layout and disking of the material is covered. Dewatering by heating is not often economical due to large energy cost required to elevate the temperature of and evaporate the high water content of organic sediment and sludge.

In recent years, large amounts of organic silt have been dredged and will continue to be removed from many harbors, rivers and estuaries because of contamination with heavy metals (Cadmium, Lead, and Mercury) and polychlorinated biphenyls (PCB's) from past, uncontrolled industrial discharges. The fine-grained material comprising organic silt accumulates heavy metals, and the organic matter adsorbs oily PCB's. The dredged material may be rendered environmentally safe using high temperature incineration, but at present it is more commonly disposed in landfills without treatment. Both fates require removal of much of the very high water content that is characteristic of organic silt, particularly after the underwater disturbance inherent with both mechanical and hydraulic dredging. Even after months of gravity settling, the water content of dredged organic silt is commonly in the range of 100% to 200% on a weight basis and the material is of semi-liquid consistency. Amorphous (non-fibrous) peat may also be present at even higher water content. In geotechnical engineering terms, the "liquidity index" of dredged organic silt after gravity dewatering often remains in the value range of one to two.

Similar to dredged organic sediment, paper mill and sewage treatment plant sludge have high organic and water content and present similar challenges for handling and disposal. Where it is not practical to beneficially apply liquid sewage sludge to farm fields, the sludge must be dewatered before disposal. In many cases this is accomplished with mechanical or belt presses. Otherwise, liquid to semi-liquid dredged sediment and sludge that have high water content are difficult to handle, expensive to incinerate, and are too unstable physically to landfill.

Considerable effort and expense is incurred with the use of various additives to adsorb or react with the excess water in dredged organic sediment. This actually adds to the weight and volume that must be disposed, which is a strong disadvantage because of the very large quantities involved. Several hundred thousand cubic yards of sediment is commonly removed in the course of each of the numerous major environmental remediation projects underway across the nation at this time.

Although extensive research and field effort has been made in recent years by dredging companies, geotechnical engineers, and research institutions, environmental cleanup projects are falling behind the committed schedules and expenses are exceeding budgets by large amounts because effective dewatering methods have not been developed for sediment with substantial organic content. But the compressibility, high water content, and moderately low permeability of organic sediment and sludge makes dewatering by consolidation feasible, provided a practical method of applying the required load to a semi-liquid material is used.

The potential effectiveness of rigid container mechanical pressing is obvious. This is done commercially on limited quantities to dewater various sludge wastes. However, moderately low permeability organic silt requires impracticably long times for mechanical pressing of the large volumes of dredged sediment. Mechanical pressing is analogous to the small scale "consolidation" test commonly performed in geotechnical labs. This test uses rigid confinement on all sides of the test specimen but the top, where external mechanical load (with weights and lever arms) presses on a rigid, but porous "stone" to compress the material.

Equations, well known to geotechnical engineers, describing the amount of soil matrix compression that occurs under net pressure (called consolidation), and the time it takes for that compression to occur, are the same irrespective of how the stress is applied. In addition to the obviousness of mechanical pressing, soil scientists and geotechnical engineers are aware that applying vacuum directly to interstitial (pore) water exerts compressive stress on the soil matrix. This is referred to as "pore water tension", the potential for which is controlled by the effective pore diameter of the soil matrix. Plant roots exert this effect on soil and air drying has the same effect, to the extreme in clay.

Pore water tension is used to stabilize excavations in inorganic silt below the water table. This is accomplished by applying vacuum to "sand points" driven into water laden silt strata. In similar configuration, vacuum is applied to wells installed in soil to enhance removal of liquid contaminants and contaminated ground water, as well as move vapor through the soil to promote natural biodegradation of organic contaminants.

In contrast, soil scientists and geotechnical engineers are not commonly familiar with application of vacuum to the interior of an air impermeable but flexible membrane enclosure, which causes atmospheric pressure acting on the outside of the membrane to exert uniform compression on any material contained within. However, this technique has been used for decades in the composite materials manufacturing industry. It can be adapted to provide a practical dewatering method for dredged organic sediment and organic sludge. In manufacturing, it is called "vacuum bagging" and is used to produce high quality laminates of fiberglass, carbon, or other reinforcing fibers bound with cementing resins. Atmospheric pressure is used to apply uniform pressure to the layers of fiber and resin to increase density, resulting in high strength after curing. This is accomplished by applying vacuum to absorbent and porous material that overlays or surrounds the piece being made, all of which is sealed from the atmosphere by placing it in a plastic bag or air impermeable membrane of appropriate size. Flat sheets of composite material are often made by laying the absorbent/porous material and impermeable membrane over the layers of fiber and liquid resin placed on a table. A bead of caulk on the table surrounding the uncured composite sandwich seals the interior (to which vacuum is applied) from the atmosphere. A variation using a porous table with vacuum applied underneath is also common.

In addition to the commonly practiced art of vacuum bagging in composite materials manufacturing, the other relevant prior art is vacuum assisted, in-situ consolidation of soil. That potential was initially described by a German engineer in 1930 and was initially used in 1952. Although that practice has not since become common, vacuum assisted consolidation has been used from time to time in various countries to "pre-consolidate" building sites on soft ground in order to avoid excessive, gradual subsidence. In this in-situ application, vacuum is applied to vertical drains installed in the soil as well as the over the ground surface by covering the area with an air impermeable membrane. Perimeter "curtain walls" of slurry are often required to provide lateral isolation of the consolidation zone. The vacuum increases the in-situ soil stress and induces consolidation, as disclosed in Menard Vacuum Consolidation, ISSMFE-TC-17. All of these applications required use of vents or drain elements installed into the ground, and differ from the use described in this patent application from prior process art in at least that respect. Most of the applications also applied gravity weight (piled soil) surcharge in addition to vacuum-induced atmospheric pressure to accomplish the required amount of pre-consolidation of soft ground building sites.

The potential for vacuum assisted consolidation of dredged sediment or waste sludge placed in a landfill is well described in technical publications by Professor Thevanayagam of the Civil Engineering Department at SUNY, Buffalo, N.Y. In-situ consolidation of hydraulic fill placed under the water is also described. The most comprehensive summary of these applications is his article titled *Vacuum-Assisted Consolidation of Coastal and Offshore Dredge Fills* (published in ASCE Geotechnical Special Publication No 65). It reviews the fundamental soil mechanics principles and some practicalities applicable to vacuum assisted, in-situ consolidation. All of the applications presented included description of combinations of horizontal and vertical drainage elements installed within the mass of the sediment being dewatered. The use of vacuum for ex-situ, pre-disposal dewatering of sediment, and sludge without use of drainage features or elements embedded within the sediment has not been obvious to practitioners, although there are large numbers of scientists and engineers active in this field.

In recent years, it has become common practice to pump hydraulically dredged sediment as well as sewage sludge into Geotubes® to accomplish some initial separation of water from the fine-grained solids. Geotubes® are simply very large, sausage-shaped skins made of water pervious "geotextile" material. Within several months after filling, the water content of the contained organic sediment is stabilized at about 100% to 200% on a weight basis. Water content can be much higher in sewage sludge or if amorphous peat is present in dredged sediment. In any case, organic materials are typically in semi-liquid condition after gravity dewatering in Geotubes®. Geotube® is a registered trademark of Nicolon Corporation of Pendergrass, Ga.

After initial gravity de-watering, fly ash and/or quick lime is sometimes added to absorb and react with the remaining excess water to provide soil-like consistency prior to land filling dredged sediment. However, this retains all the water weight, to which the additives add about 25% to the already large weight of the sediment with its excess water. The weight increase and cost of additives results in disposal costs that are often twice what would be incurred if vacuum bag dewatering were used to remove water, decrease the disposal weight and volume, and provide workable consistency. Without dewatering or stabilization treatment, disposal of semi-liquid dredgings at landfills can be triple the standard disposal fee of $20/ton, amounting to about $60/ton.

Sewage and paper mill sludge contained in Geotubes® can be further de-watered by air drying if covered from precipitation, but that process may take too long.

Accordingly, there is a clearly felt need in the art for dredged sediment and sludge dewatering by vacuum bag method, which decreases the amount of time and cost required to dewater materials, particularly those with substantial fine-grained organic content, and which does not require internal drains placed within the sediment or waste sludge mass.

SUMMARY OF THE INVENTION

The present invention provides dredged sediment and sludge dewatering by vacuum bag method with decreased cost and complexity relative to the prior art. The vacuum bag method works best with dredged sediment containing significant organic content (organic silt and/or amorphous peat) and organic sludge, because these materials compress substantially under one atmosphere of net pressure. They also have sufficient hydraulic conductivity to accomplish dewatering in a practical amount of time. Vacuum bag dewatering of clay and inorganic silt may only be marginally effective.

Dewatering by vacuum bag method (vacuum bag method) includes at least one sediment or sludge enclosure, a porous media spacer, an air impermeable sheet or membrane, and a vacuum source. Depending on the transmissivity of the porous media spacer, one or more perforated drain tubes may be required to provide uniform distribution of vacuum across the porous media spacer area. If multiple drain tubes are used, they may be connected to a common manifold.

Each sediment or sludge enclosure is fabricated from a sheet material that is water permeable. Hydraulically dredged sediment or waste sludge is initially a liquid slurry which is pumped into the enclosure, which may be a Geotube®. In some cases, mechanically dredged sediment may be placed on an enclosure sheet, which can be folded over the sediment mass to close any open ends. After placing the porous media spacer and any drain tubes, the assembly is covered or surrounded in an air impermeable membrane. Vacuum is then applied to the porous media spacer, either directly or via manifold and perforated drain tubes.

The porous media spacer is placed against at least one perimeter surface of the sediment or sludge enclosure, and preferably against both the top and bottom surfaces. The porous media spacer may be any structure that has an incompressible height, a flexible length, and has adequate hydraulic transmissivity. Each drain tube is preferably a tube with a plurality of small holes formed therethrough. Drain tubes are placed in contact with the porous media spacer, which is separated from the atmosphere by the air impermeable membrane. Multiple drain tubes are connected to a vacuum manifold, preferably located inside the air impermeable membrane.

A water knockout tank is preferably attached to the pipe leading from the vacuum manifold. A vacuum source is attached to the water knockout tank to apply a vacuum to the vacuum bag system. A positive displacement pump is preferably connected to the water knockout tank to remove water therefrom.

The at least one sediment or sludge enclosure may be placed on a water and air impermeable foundation, such as compacted clay. An air impermeable sheet is placed over the at least one sediment enclosure (and porous media spacer and any drain tubes and manifold) and the perimeter is sealed to the impermeable foundation to form the vacuum bag. In a second embodiment, if the foundation is air or water permeable, a second air impermeable sheet is placed on top of the permeable foundation. The at least one sediment or sludge enclosure is placed on the second impermeable sheet. The perimeters of the impermeable sheets are sealed to each other. In a third embodiment, the at least one sediment or sludge enclosure is placed in a barge. The air impermeable sheet is placed over the sediment or sludge enclosure, the porous media, and any drain lines and manifold. The air impermeable sheet is sealed to the side walls of the barge. In a fourth embodiment, a composite vacuum bag is used. The composite vacuum bag includes the sediment or sludge enclosure, the porous media spacer and any drain tubes, and the air impermeable membrane. The porous media spacer is placed against at least one perimeter surface of the sediment or sludge enclosure, but preferably against both the top and bottom. At least one drain tube may be placed in contact with the porous media spacer at the perimeter of the sediment or sludge enclosure. The air impermeable membrane surrounds the sediment or sludge enclosure, the porous media spacer, and any drain tubes and manifold. Each end of the air impermeable sheet is removably sealed to itself.

In a fifth embodiment, the composite vacuum bag is fitted with inflatable buoyancy bags enabling it to act as its own barge that can be temporarily submerged under water. Alternatively, the composite bag itself can be inflatable to lift and transport the composite bag, after sediment consolidation. Submersion increases the consolidation stress (net pressure) acting on the outside of the air impermeable membrane, thereby increasing the amount of water removed from the dredged sediment.

The vacuum bag method is preferably implemented in the following manner. A relatively flat and preferably gently inclined surface near the dredging site or source of sludge is chosen. The foundation is air and water permeable, or impermeable, depending on the vacuum bag embodiment. A barge can also provide a suitable surface, or the method can be applied without a barge in a body of water. Any drain tubes are connected to a vacuum manifold, which is connected via pipe to the water knock out tank and vacuum pump. The vacuum pump is turned-on. The vacuum applied through the system to the porous media spacer causes net atmospheric pressure acting on the outside of the air impermeable membrane to compress the enclosed sediment or sludge, thereby removing water, and further withdraws water emerging from the enclosure through the porous media, drain tubes and manifold.

The amount of time required to dewater the sediment or sludge to the extent that can be accomplished by atmospheric pressure is determined by the hydraulic conductivity of the material and the layer thickness. If the porous media spacer is placed against both the top and bottom surfaces of the sediment or sludge enclosure, consolidation time is one quarter of the time required if placed against only one surface. The vacuum source applies vacuum through the water knockout tank. The positive displacement pump periodically removes water from the water knockout tank.

Accordingly, it is an object of the present invention to provide a vacuum bag method, which removes water from dredged sediment or waste sludge without the necessity of drainage devices placed within the dredged sediment or sludge.

These and additional objects, advantages, features and benefits of the present invention will become apparent from the following specification.

DETAILED DESCRIPTION OF THE PREFERRED EMBODIMENTS

Figure 1:
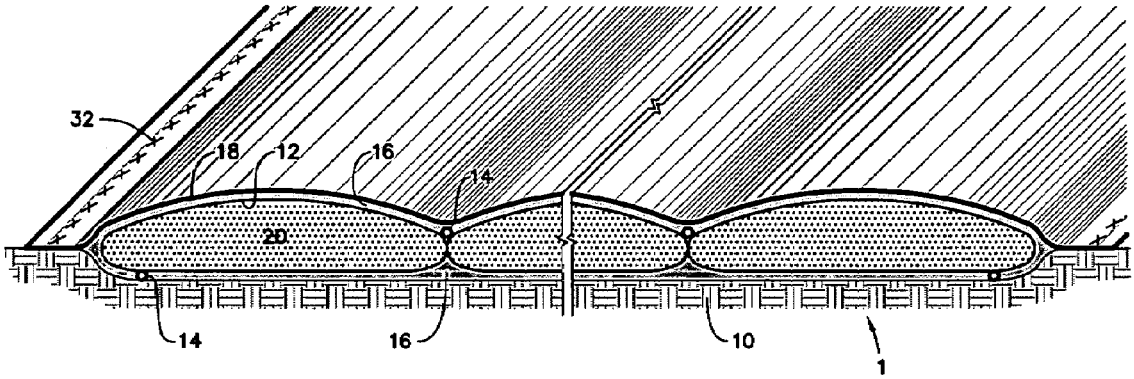
FIG. 1 is a perspective cross sectional view of a vacuum bag method utilizing an air impermeable foundation in accordance with the present invention.

With reference now to the drawings, and particularly to FIG. 1, there is shown a perspective cross sectional view of a dredged sediment or sludge dewatering by vacuum bag method. The dredged sediment of sludge dewater by vacuum bag method (vacuum bag method) 1 preferably includes an impermeable foundation 10, at least one sediment or sludge enclosure 12, at least one drain tube 14, a porous media spacer 16, an air impermeable sheet 18, and a vacuum source. Each sediment or sludge enclosure 12 is fabricated from a sheet material that is water permeable. The sediment or sludge enclosure 12 is required to confine the fine-grained particles comprising the dredged sediment or sludge 20, while allowing water to pass through the enclosure without restriction.

Without the sediment enclosure 12, the porous media spacer 16 would clog and the removed water would contain sediment or sludge solids. The sediment or sludge enclosure 12 is preferably fabricated from synthetic fabric: woven, non-woven, or a combination thereof. The fabric may consist of either a sheet of geotextile, or geotextile formed into Geotubes®. The effective opening size of the geotextile will typically need to be in the range of 0.1 to 0.5 mm, depending on the grain size distribution of the sediment or sludge. Permittivity of the geotextile enclosure material will typically be in the range of 0.1/second to 1/second, depending on the hydraulic conductivity of the sediment being compressed. The vacuum bag method works best with dredged sediment and sludge containing organic material and excess water, because these materials substantially compress under net normal stress of one atmosphere, and have sufficient hydraulic conductivity for dewatering (consolidation) to take place in a practical amount of time.

Figure 3:
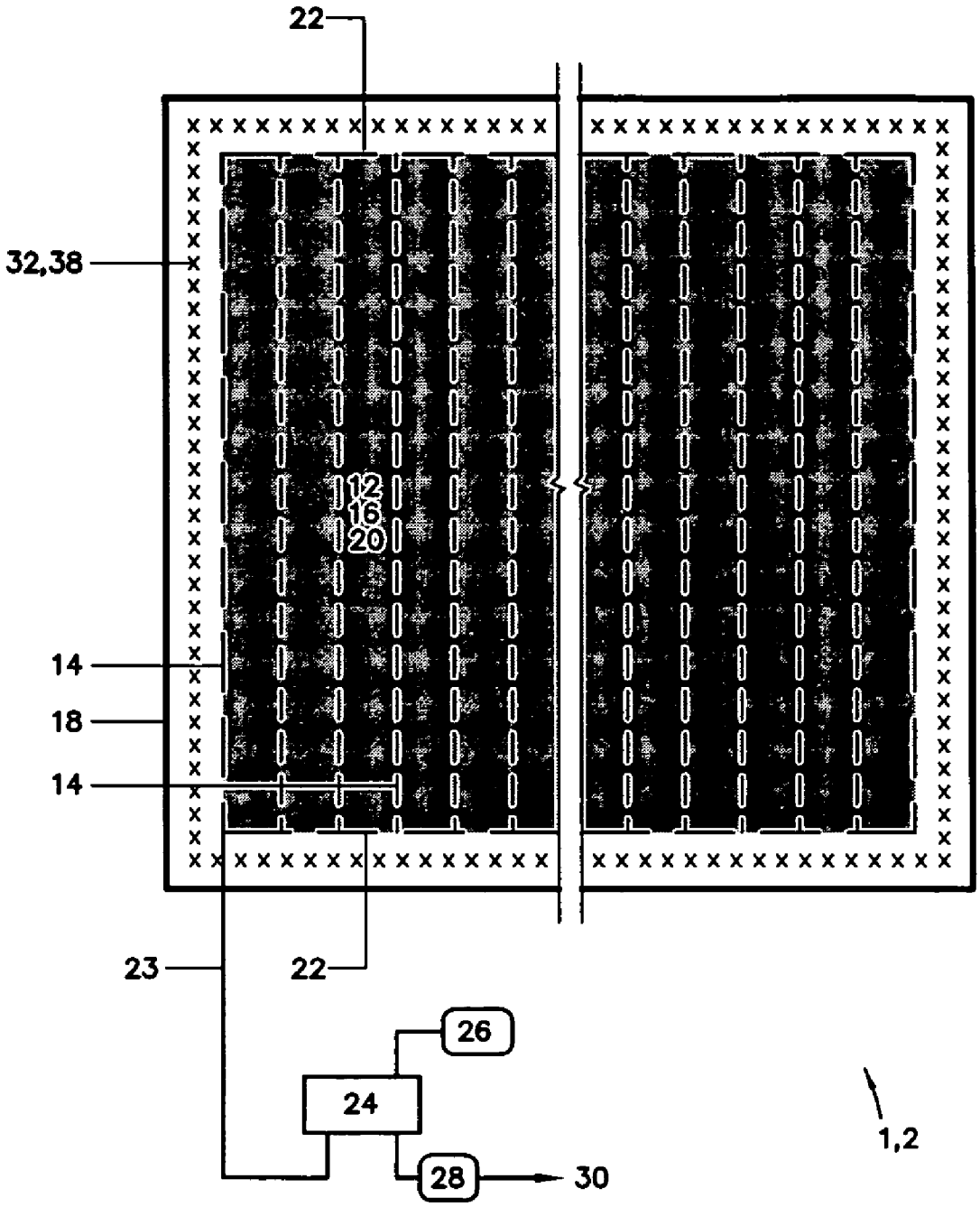
FIG. 3 is a top view of a vacuum bag method with a schematic diagram of components in accordance with the present invention.

Each drain tube 14 is preferably a tube with a plurality of small holes formed therethrough. Any drain tubes 14 are placed in contact with the porous media spacer on the perimeter of each sediment enclosure 12. With reference to FIG. 3, at least one end of the multiple drain tubes 14 are connected to a vacuum manifold 22. A water knockout tank 24 is preferably connected by pipe 23 to the vacuum manifold 22. A vacuum pump 26 is attached to the water knockout tank 24 to apply a vacuum to the vacuum manifold 22. A positive displacement pump 28 is also connected to the water knockout tank to periodically discharge water 30 therefrom. The porous media spacer 16 is placed against at least one perimeter surface (such as a top or a bottom surface) of the sediment or sludge enclosure 12, and preferably against both the top and bottom surfaces or entirely surrounding the enclosure 12.

The drains tubes 14 could also be integrated into or with the porous media spacer 16. The porous media spacer 16 must have high enough transmissivity to uniformly distribute negative pressure across the surfaces of the sediment or sludge 20 being dewatered and also collect water with negligible head loss. Porosity must be maintained under compressive load of at least 2,000 psf. If the transmissivity of the porous media spacer 16 is great enough, the drain tubes 14 are not required. Easily removable and flexible manufactured porous media spacer 16 may be most practical at the top of the sediment enclosure 12. Uniform aggregate may in some cases be most practical underneath. The porous media spacer 16 need not provide complete coverage over the surfaces, but spacing between strips of the porous media will preferably not exceed one half of the thickness of the sediment or sludge layer.

The vacuum bag method 1 is preferably used with a water and air impermeable foundation 10, such as clay. An air impermeable sheet is placed over the at least one sediment or sludge enclosure 12 and the perimeter is sealed 32 to the impermeable foundation 10 to form the vacuum bag method 1.

Figure 2:
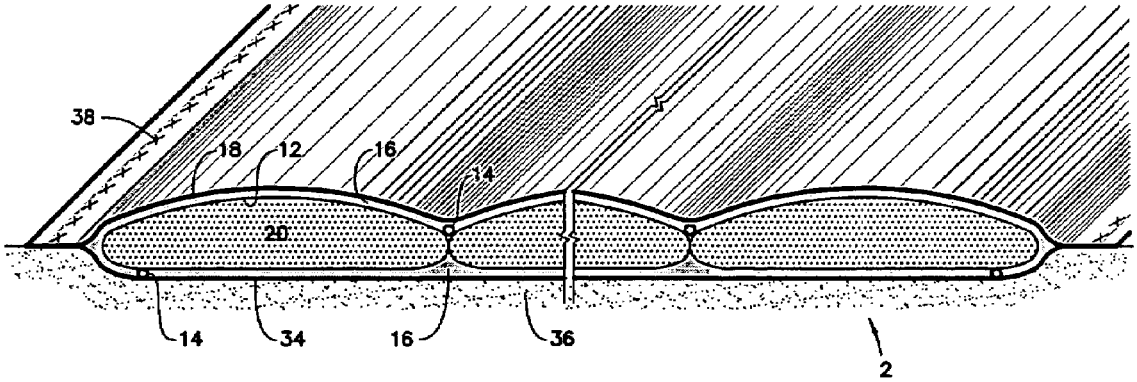
FIG. 2 is a perspective cross sectional view of a second embodiment of a vacuum bag method utilizing a permeable foundation in accordance with the present invention.

FIG. 2 discloses a second embodiment of the vacuum bag method 2. A second air impermeable sheet 34 is used if the foundation 36 is permeable. The perimeter of the impermeable sheet 18 is sealed 38 to a perimeter of the second impermeable sheet 34, with the at least one sediment enclosure 12, any drain tubes 14, porous media spacer 16, and the dredged sediment or sludge 20 contained therein.

Figure 4:
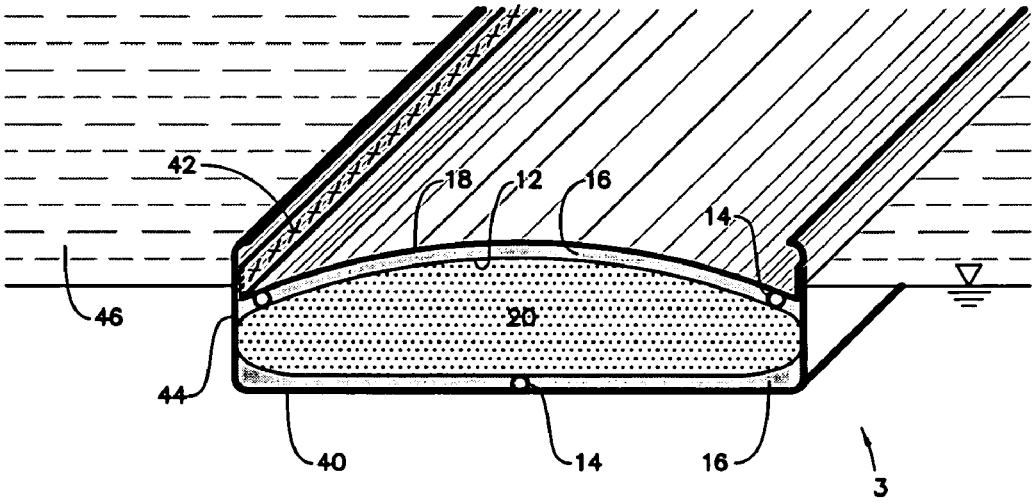
FIG. 4 is a perspective cross sectional view of a third embodiment of a vacuum bag method utilizing a barge as an impermeable foundation in accordance with the present invention.

FIG. 4 discloses a third embodiment of the vacuum bag method 3. The at least one sediment or sludge enclosure 12 is placed in a barge 40. The air impermeable sheet 18 is sealed 42 to side walls 44 of the barge 40. The barge 40 floats in a body of water 46.

Figure 5:
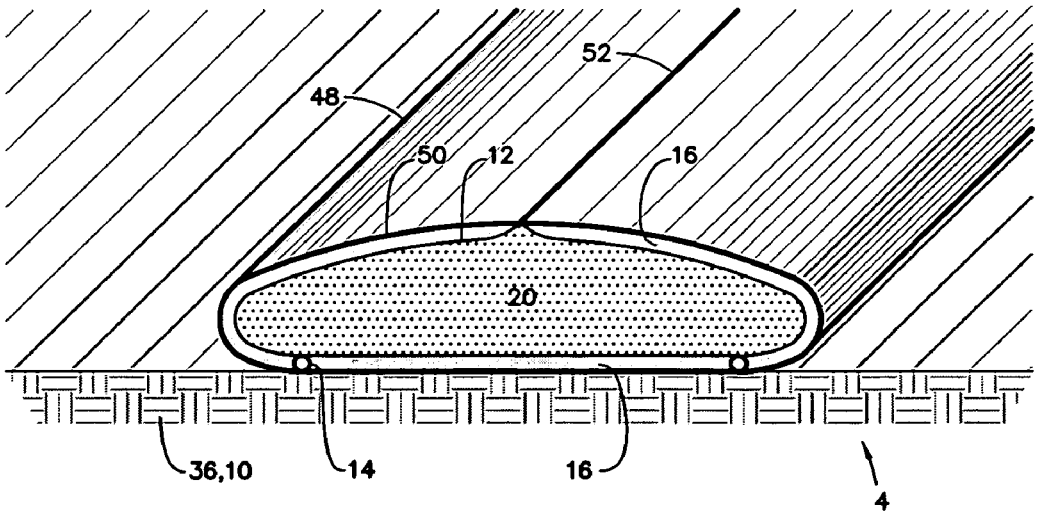
FIG. 5 is a perspective cross sectional view of a fourth embodiment of a vacuum bag method utilizing a composite vacuum bag, which does not require a specific type of foundation, in accordance with the present invention.
Figure 6A:
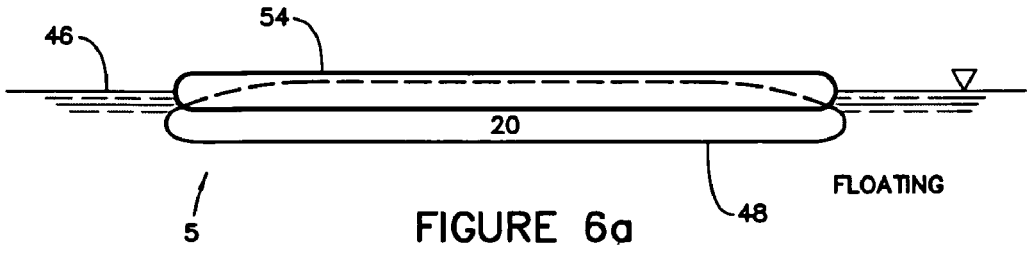
FIG. 6*a* is a side view of a fifth embodiment of vacuum bag method equipped with an inflatable flotation device floating in water in accordance with the present invention.
Figure 6B:
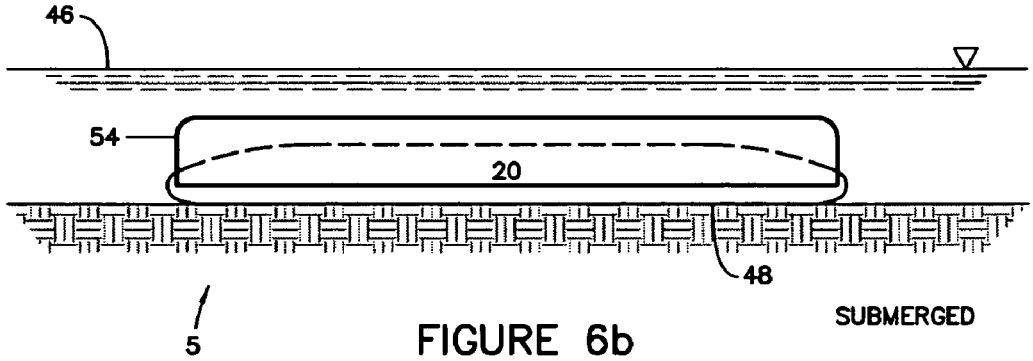
FIG. 6*b* is a side view of a fifth embodiment of vacuum bag method equipped with an inflatable flotation device submerged in water in accordance with the present invention.
Figure 7A:
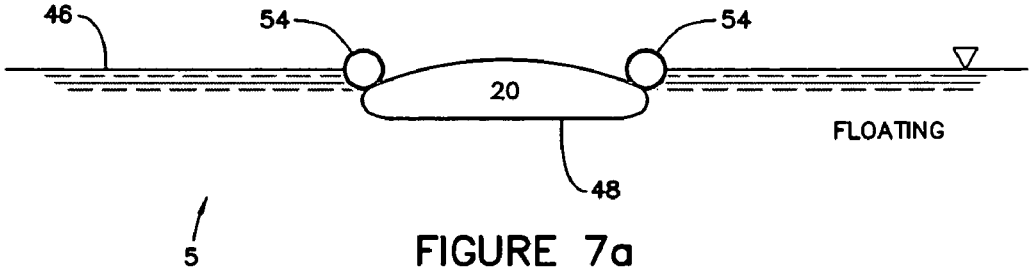
FIG. 7*a* is an end view of a fifth embodiment of vacuum bag method equipped with an inflatable flotation device floating in water in accordance with the present invention.
Figure 7B:
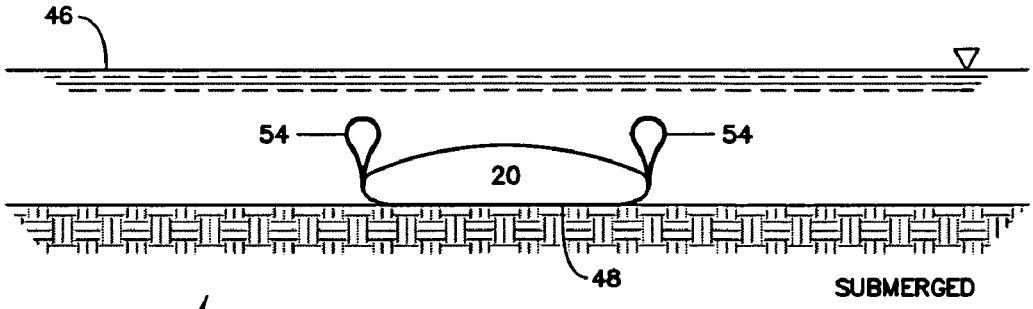
FIG. 7*b* is an end view of a fifth embodiment of vacuum bag method equipped with an inflatable flotation device submerged in water in accordance with the present invention.

FIG. 5 discloses a fourth embodiment of the vacuum bag method 4, in the form of a composite vacuum bag 48. The composite vacuum bag 48 includes the sediment or sludge enclosure 12, any drain tubes 14, the porous media spacer 16, and an air impermeable membrane 50. The porous media spacer 16 is placed against at least one perimeter surface of the sediment or sludge enclosure 12, and preferably against both top and bottom or surrounding the enclosure 12. Any drain tubes 14 are placed in contact with the porous media spacer 16 on the perimeter of the sediment or sludge enclosure 12. The air impermeable membrane 50 surrounds the sediment or sludge enclosure 12, the porous media spacer 16, and any drain tubes 14. Opposing ends of the air impermeable sheet 50 are removably sealed 52 to each other. The composite vacuum bag 48 may be placed on a permeable foundation 36, or an impermeable foundation 10, or in a barge 40.

FIGS. 6*a*-7*b* disclose a fifth embodiment of the vacuum bag method 5, in the form of a composite vacuum bag 48, where at least one inflatable flotation device 54 is attached thereto. The combination allows the composite vacuum bag 48 with at least one inflatable flotation device 54 to float on the water body 46 or be submerged in a body of water 46. Submersion increases the available net consolidation stress above, which is possible using atmospheric pressure alone, thereby increasing the amount of water removed from the contained sediment in the same period of time.

However, the composite vacuum bag 48 of the vacuum bag method 5 does not require use of the inflatable flotation device 54. The composite vacuum bag 48 containing sediment or sludge 20 would be lowered in the body of water 46. The external pressure from the body of water 46 plus the atmosphere acting on the outside of the composite vacuum bag 48 would force the water from the sediment or sludge 20 into the porous media spacer 16. A positive displacement pump 28 removes the water from the porous media spacer 16, thereby reducing pressure inside the composite vacuum bag 48 to less than the external pressure. The water knockout tank 24 and vacuum pump 26 are eliminated in the vacuum bag method 5. The composite vacuum bag 48 would be raised in the body of water 46 by pumping air into the composite vacuum bag 48 or the attached flotation device 54 through the at least one drain tube 14 with an air pump.

The vacuum bag methods 1-5 are preferably implemented in the following manner. A relatively flat and preferably gently inclined surface near a dredging or sludge generating site is chosen. A bottom of the barge 40 can also provide a working surface. The vacuum bag method can also be implemented in a body of water, if the at least one inflatable flotation 54 is attached to the composite vacuum bag 48 or if the composite vacuum bag 48 is inflatable. Any drain tubes 14 or vacuum manifolds 22 are connected via pipe to the water knockout tank 24. The vacuum pump 26 is attached to the water knockout tank 24 to apply a vacuum to the system. The positive displacement pump 28 can be connected to the water knockout tank 24 to remove discharge water 30 therefrom.

The vacuum pump 26 creates the negative pressure applied as described to the porous media spacer 16 located on the inside of the air impermeable membrane 18. With atmospheric pressure acting on the outside of the air impermeable membrane 18, the enclosed sediment 20 is compressed, thereby removing water 30 from it.

Because the resulting volumetric flow rate of water 30 emerging from the dredged sediment 20 is not high, relatively small displacement pumps capable of exerting vacuum at high percentages of atmospheric pressure are most efficient. Aside from pump losses, the amount of mechanical work required to vacuum bag dewater dredged sediment is not great, only requiring low horse power provided the system is effectively sealed from the atmosphere. The strength of vacuum that can be maintained directly effects how much water will be removed. This is determined by the effectiveness of the seal 32, 38, 42, 52, which also largely determines how much power is required.

Although not essential if the porous media spacer 16 has sufficient transmissivity, it will usually be most practical to distribute vacuum uniformly over porous media spacer area across the perimeter surfaces of the at least one sediment or sludge enclosure 12 with at least one drain tube 14. The drain tube 14 must be strong enough not to collapse under the applied vacuum and should be of sufficient diameter to result in negligible head loss of the water flowing through it. Spacing of the drain tubes 14 is determined by the transmissivity of the porous media spacer 16. Generally, it is desirable to remove water that emerges from the sediment or sludge 20, before it reaches the vacuum pump 26 through the use of the knockout tank 24. Alternatively, a pump capable of passing water through it can be used. This would eliminate the need for a water knock out tank and discharge pump.

Valves and gauges are required to control and monitor elements of the vacuum system performance, but are not shown in the figures. Valves and vents are located on pipes 23 joining separate sediment or sludge enclosures 12 to throttle the amount of applied vacuum and allow entry of atmospheric pressure to facilitate independent assembly and disassembly of separate enclosures 12. Valves are located upstream and downstream of the water knockout tank 24, and upstream of a water discharge pump 28. A vacuum relief valve should be located just upstream of the vacuum pump 26. Vacuum gages should be located on the water knockout tank 24 and at spatial intervals on the water impermeable sheet 18.

Finally, vacuum applied through the system to the porous media spacer 16 causes net atmospheric pressure acting on the outside of the air impermeable membrane 18, 50 to compress the enclosed sediment or sludge 20, thereby removing water 30, and further withdraws water 30 emerging from the enclosure 12 through the porous media spacer 16, the drain tubes 14, and the manifold 22. The vacuum pump 26 supplies vacuum to the system through the water knockout tank 24. The positive displacement pump 28 removes water from the water knockout tank 24.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A method dewatering dredged sediment or sludge, comprising the steps of:

filling a water pervious sediment or sludge enclosure with dredged sediment or sludge;

placing a porous media spacer against at least one perimeter surface of said sediment or sludge enclosure;

surrounding said porous media spacer and said sediment or sludge pervious enclosure with a water and air impermeable membrane;

applying a vacuum to said porous media spacer to cause said impermeable membrane to compress said sediment or sludge and thereby remove water; and attaching at least one inflatable flotation device to said at least one water and air impermeable membrane surrounding said porous media and said sediment or sludge pervious enclosure.

2. The method dewatering dredged sediment or sludge of claim 1, further comprising the step of:

placing at least one drain tube in contact with said porous media spacer on a perimeter of said sediment or sludge enclosure.

3. The method dewatering dredged sediment or sludge of claim 2, further comprising the step of:

forming a plurality of openings through each one of said at least one drain tube.

4. The method dewatering dredged sediment or sludge of claim 1, further comprising the step of:

providing a means to discharge water removed from said sediment or sludge.

5. A method dewatering dredged sediment or sludge, comprising the steps of:

filling at least one sediment or sludge enclosure with dredged sediment or sludge;

placing a porous media spacer against at least one perimeter surface of each one of said at least one sediment or sludge enclosure;

surrounding said porous media spacer and said sediment or sludge enclosure with an air impermeable membrane to form a vacuum bag; and lowering said vacuum bag into a body of water, pressure from the body of water and atmosphere causing said air impermeable sheet to compress said sediment or sludge enclosure to transfer water into said porous media spacer, drawing the water from said porous media spacer.

6. The method dewatering dredged sediment or sludge of claim 5, further comprising the step of:

placing at least one drain tube in contact with said porous media spacer on a perimeter of each one of said at least one sediment or sludge enclosure.

7. The method dewatering dredged sediment or sludge of claim 6, further comprising the step of:

forming a plurality of openings through each one of said at least one drain tube.

8. The method dewatering dredged sediment or sludge of claim 6, further comprising the step of:

pumping air into said vacuum bag through said at least one drain tube to raise said vacuum bag in the body of water.

9. The method dewatering dredged sediment or sludge of claim 5, further comprising the step of:

pumping water out of said porous media spacer with a positive displacement pump.

10. The method dewatering dredged sediment or sludge of claim 5, further comprising the step of:

attaching at least one inflatable flotation device to said at least one water and air impermeable membrane surrounding said porous media and said sediment or sludge pervious enclosure.

11. The method dewatering dredged sediment or sludge of claim 10, further comprising the step of:

pumping air into said at least one inflatable flotation device to raise said vacuum bag in the body of water.

* * * * *